United States Patent [19]

Page

[11] Patent Number: 4,921,575

[45] Date of Patent: May 1, 1990

[54] COUCH PRESS TRANSFER APPARATUS

[75] Inventor: Robert E. Page, Davis, Ill.

[73] Assignee: Beloit Corporation, Beloit, Wis.

[21] Appl. No.: 411,804

[22] Filed: Sep. 25, 1989

[51] Int. Cl.[5] ..... D21F 2/00

[52] U.S. Cl. ..... 162/306; 162/205; 162/305; 162/358

[58] Field of Search ..... 162/305, 306, 307, 358, 162/360.1, 205

[56] References Cited

U.S. PATENT DOCUMENTS

| | | | |
|---|---|---|---|
| 2,204,426 | 6/1940 | Millspough | 162/306 |
| 2,415,351 | 2/1947 | Hornbostel et al. | 162/306 |
| 2,843,025 | 7/1958 | Holden | 162/307 |
| 2,850,951 | 9/1958 | Holden | 162/305 |
| 3,556,936 | 1/1971 | Miyamoto | 162/306 |
| 3,595,745 | 7/1971 | Cronin | 162/306 |
| 3,600,275 | 8/1971 | Cronin | 162/306 |
| 3,671,389 | 6/1972 | Wahlstrom | 162/205 |
| 4,483,745 | 11/1984 | Wicks et al. | 162/205 |

FOREIGN PATENT DOCUMENTS

| | | | |
|---|---|---|---|
| 565514 | 11/1958 | Canada | 162/306 |
| 1117992 | 11/1961 | Fed. Rep. of Germany | 162/306 |

*Primary Examiner*—Karen M. Hastings

*Attorney, Agent, or Firm*—Dirk Veneman; Raymond Campbell; Gerald Mathews

[57] ABSTRACT

Apparatus for transferring a newly formed paper web from the forming fabric over a couch roll in a papermaking machine includes a transfer roll which guides a pick-up felt into nipping engagement with the paper web over the couch roll. The nip is located intermediate the circumferentially spaced ends of a vacuum zone on the surface of the couch roll. The web with the forming fabric on one side and the pick-up felt on the other side is guided onto the transfer roll surface by the forming fabric downstream of the nip and is transferred onto the pick-up felt. The transfer roll has a vacuum zone located downstream of where it is wrapped by the forming fabric. The application of pressure on the web over the couch roll prior to, and in conjunction with, the nip operates to further dewater the web as well as to facilitate its transfer to the pick-up felt.

3 Claims, 2 Drawing Sheets

COUCH PRESS TRANSFER APPARATUS

BACKGROUND OF THE INVENTION

This invention relates to the transfer of a paper web from the forming section to the press section in a papermaking machine. More particularly, this invention relates to the transfer of a paper web from a forming fabric to a pick-up felt in conjunction with further dewatering of the web. Still more particularly, this invention relates to the transfer of a paper web from a forming fabric over a vacuum zone on a couch roll which is effected by the nipping engagement of a pipe-up felt against the web by a transfer roll which is also equipped with a vacuum zone.

In modern papermaking machines, the transfer of the paper web from the forming section to the press section must always be effected positively, that is, the paper web must always be carried on the surface of a forming fabric or a pick-up fabric, in order to prevent web breakage at high papermaking speeds. Prior web pick-up arrangements have utilized bringing a pick-up felt into engagement with the web over a span of the forming fabric between a couch roll and a fabric turning roll. In fourdrinier-type forming arrangements, the couch roll defines the end of the generally horizontal forming section at which point the fabric is directed downwardly with the web on its surface, and it is in this downwardly extending portion of fabric travel that the transfer is effected. A typical such arrangement is shown in Wicks et al, U.S. Pat. No. 4,483,745.

It has also been common practice to pick the freshly formed paper web off the forming fabric by bringing a pick-up fabric, such as a felt, into nipping engagement with the web over a roll within the forming fabric, such as the couch roll or the fabric turning roll. Such an arrangement is shown in Wahlstrom et al, U.S. Pat. No. 3,671,389.

These arrangements are adequate and work well at papermaking speeds below about 1100 meters per minute, or with adequately dried webs capable of withstanding a relatively high vacuum pressure in the transfer roll, or with relatively heavy paper webs, or with some combination of all of these parameters.

In many modern papermaking machines, the web is formed between two, co-running forming fabrics which produce superior paper formation and more uniform fines and fillers distribution which provides a higher quality paper product. One sheet characteristic which has not always improved in such two-fabric paper web forming apparatus is the dryness of the web leaving the forming section and guided into the press section. The more relatively wet the paper web is, the greater the chance of its breaking, especially at the critical point of its removal from the forming fabric and transfer into the press section.

SUMMARY OF THE INVENTION

This invention provides for both additional dewatering of the web while it is still being carried by the forming fabric, while at the same time providing for a positive transfer of the web onto a pick-up felt which conveys it directly into the first press nip. Thus, this invention is especially suitable for the transfer of a web from a secondary couch roll in a two-fabric papermaking apparatus.

In this invention, the web is first subjected to additional dewatering pressure by carrying the web over a vacuum zone on the couch roll immediately prior to a nip with a transfer roll. The nip expresses, or urges, additional water into the couch roll through the couch roll vacuum zone. Further, the forming fabric on which the web is being carried, wraps the web on the pick-up felt over an arcuate portion of the periphery of the transfer roll downstream of the nip to guide the web away from the couch roll and thereby minimize rewetting by water flung outwardly through the holes in the couch roll shell coming off the vacuum zone. This improves web dryness. These functions all occur prior to, or during, the actual transfer of the web from the forming fabric onto the pick-up felt. Most of the so-called "white water", as the water in the forming section of a papermaking machine is called by papermakers, is thus removed in the forming section through the forming fabric, thereby minimizing contamination of the pick-up felt with fines and fillers.

Downstream of the arcuate portion of the transfer roll surface wrapped by the forming fabric is a vacuum zone which functions to both encourage transfer of the web onto the felt from the forming fabric and to maintain it there after transfer. The relatively greater permeability of the forming fabric compared with that of the pick-up felt produces a greater affinity of the web for the pick-up felt before the web is subjected to the vacuum zone pressure over the transfer roll.

Accordingly, it is an object of this invention to provide for a positive transfer of a paper web from a forming fabric onto a pick-up felt in a papermaking machine.

It is another object of this invention to provide a combination web dewatering nip and web transfer between a forming fabric and pick-up felt in a papermaking machine.

Another object of this invention is to provide a paper web transfer apparatus and method which is especially suitable for transferring relatively wet paper webs from the forming section to the press section in a papermaking machine.

Still another object of this invention is to provide a method and apparatus for improving the web dryness of a paper web, particularly one formed on a two-fabric papermaking machine, going into the first press nip.

Still another object of this invention is to enhance white water removal in the forming section, thereby minimizing contamination of the pick-up felt.

A feature of this invention is the provision of the application of a vacuum zone in the transfer roll which begins after the nip with the couch roll.

These and other objects, features and advantages of this invention will become more readily apparent to those skilled in the art upon reading the description of the preferred embodiment in conjunction with the attached drawings.

IN THE DRAWINGS

DESCRIPTION OF THE PREFERRED EMBODIMENT

Figure 1:
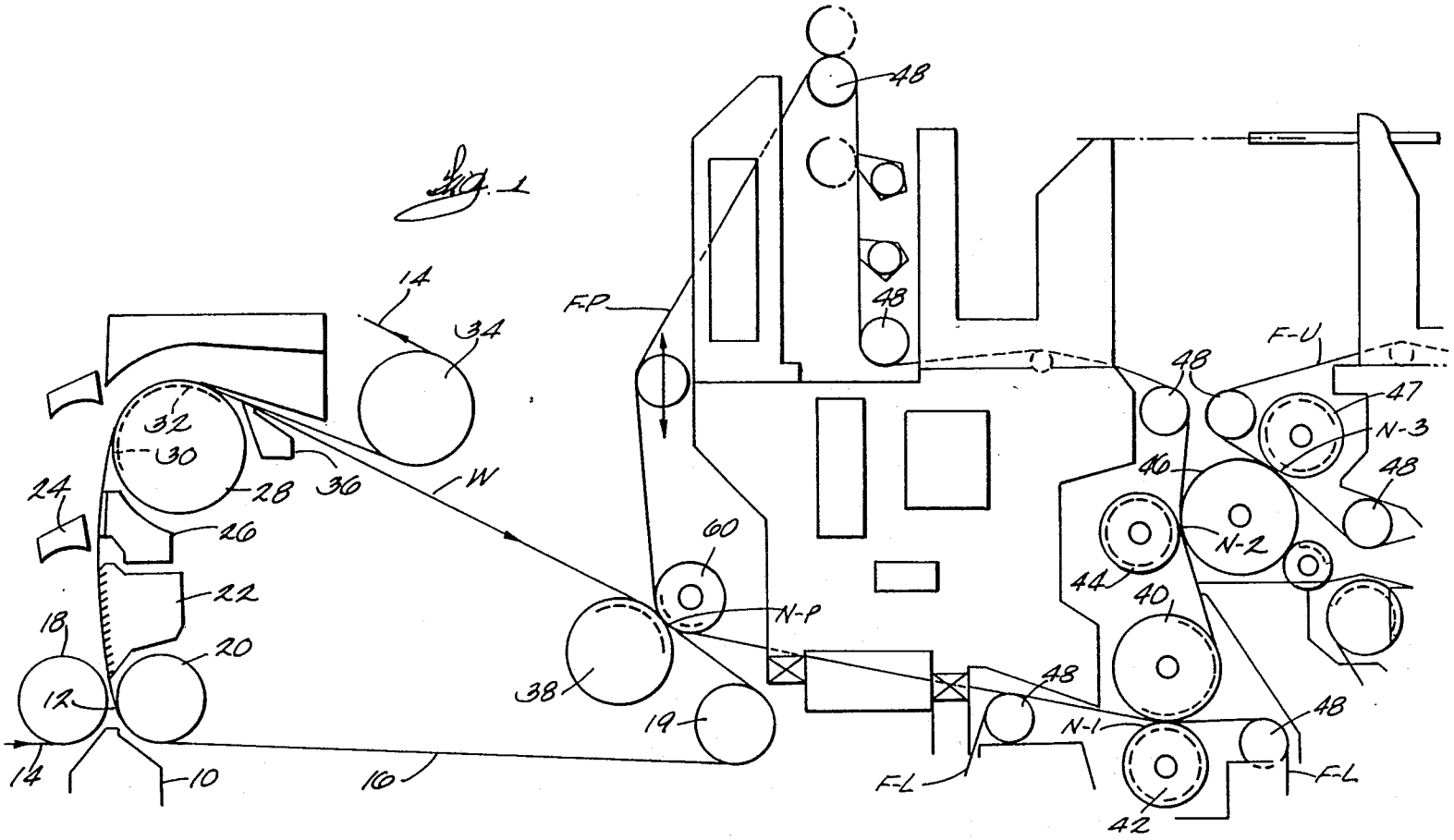
FIG. 1 is a side-elevational view of a two-fabric papermaking machine which illustrates the couch press and transfer apparatus of this invention as well as the press section of a papermaking machine.

As shown in FIG. 1, a headbox 10 projects a dilute, aqueous slurry of wood pulp fibers, commonly known as stock, into a converging throat 12 formed between first and second looped forming fabrics 14,16 which are guided around a corresponding pair of breast rolls 18,20 and are directed into co-running travel on either side of the stock slurry over a series of vertically arrayed dewatering elements 22, 24 and 26 which serve to guide the forming fabrics in a gently curving, substantially vertically arrayed path of travel upwardly over a first couch roll 28. Water is withdrawn inwardly through the foraminous surface of first couch roll 28 over a forming zone which is defined by a suction box with the roll having upstream and downstream seals 30,32, respectively. Downstream of the first couch roll 28, the first forming fabric 14 is directed away from the web W travelling on the second forming fabric 16 as the first fabric 14 travels over a tail roll 34. A foil 36 serves to removal free water travelling on the underside of the second forming fabric 16.

The second forming fabric 16, having the web W carried on its surface, then travels downwardly over a secondary couch roll 38 where it is transferred to a looped pick-up felt F-P which also functions as a first press felt. The web W remains on the underside of the pick-up/press felt F-P through the first press nip N-1 between first (suction) and second (grooved) press rolls 40,42. A lower press felt F-L is directed into co-running engagement with the web and pick-up felt for travel through the first press nip N-1. The web is retained on the first press felt F-P and subsequently travels through a second press nip N-2 between a second pair of press rolls 44,46. The web W, having a great affinity for the smooth, impervious surface of press roll 46, transfers from the pick-up/press felt F-P to the surface of the press roll 46 where it proceeds through the remainder of the press section and through the remaining downstream sections of the papermaking machine. Another press roll 47 and an upper felt F-U form a third nip N-3 with the web. A plurality of felt guide rolls 48 guide the felts F-P, F-L, F-U in their looped paths of travel.

Figure 2:
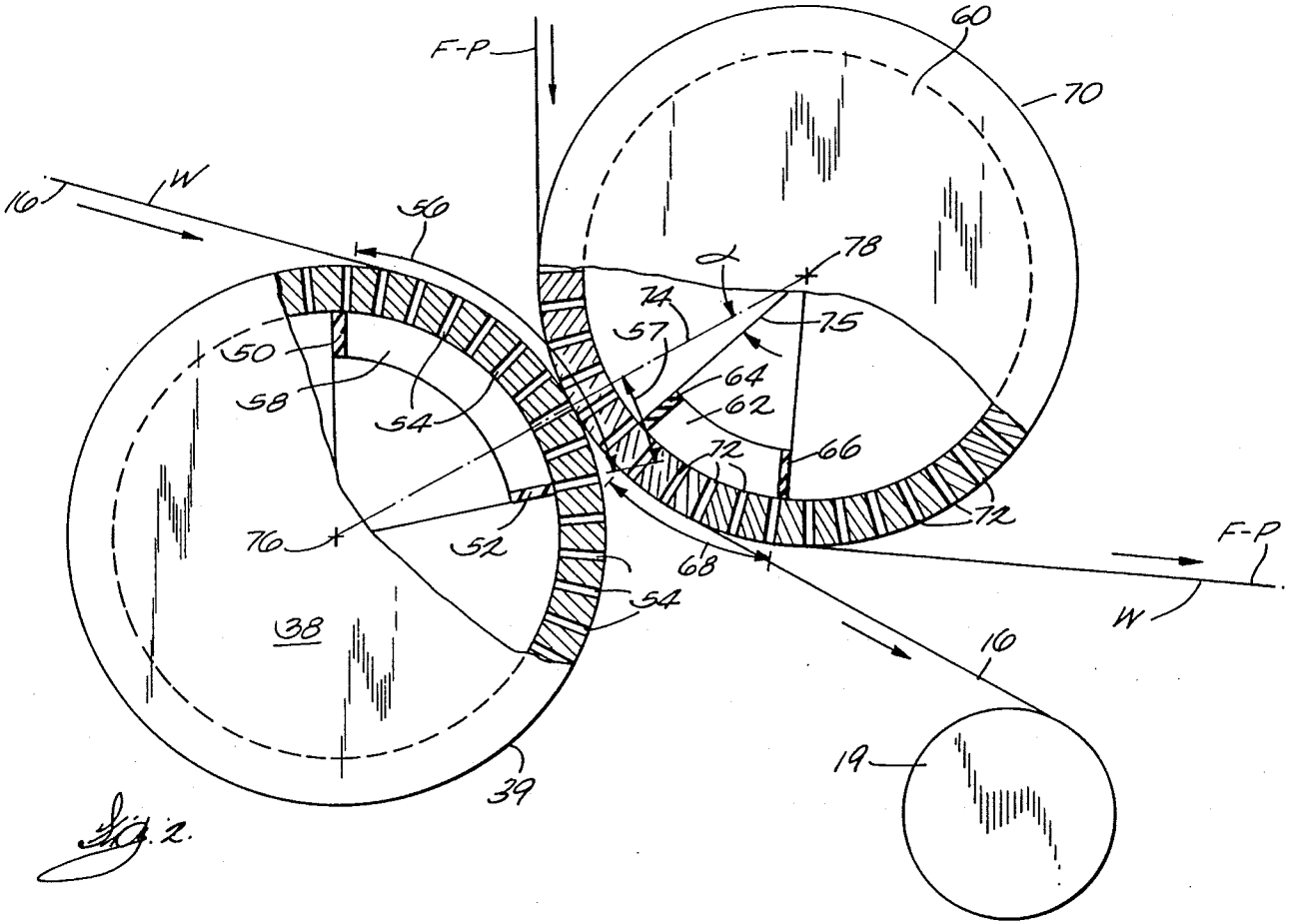
FIG. 2 is a side-elevational view, with partial broken-away sections, of the paper web dewatering and transfer apparatus shown in FIG. 1.

FIG. 2 illustrates the invention residing in the couch dewatering press and web transfer more clearly. The web W carried on forming fabric 16 is conveyed onto the foraminous surface of couch roll 38. The construction of couch rolls is well-known in the papermaking industry, so the details of the individual elements, such as the internal suction box, the manner in which a source of vacuum is applied to the suction box through the end of the roll to provide the vacuum pressure, and the size and type of holes, or openings, through the roll shell 39 forming the foraminous surface of the roll shell will not be discussed further.

The suction box providing vacuum pressure within the couch roll 38 is defined by upstream (leading) and downstream (trailing) seals 50,52, respectively, as well as end seals (not shown). A multitude of small holes 54 are drilled through the roll shell to provide a means to receive water from the web W, through forming fabric 16 and into the suction box 58. The arcuate area on the roll surface over the leading and trailing seals 50,52 is known as a vacuum zone 56.

A transfer roll 60, having a construction similar to couch roll 38, is disposed opposite couch roll 38 and guides pick-up/press felt F-P into nipping engagement with the web W on forming fabric 16 over the couch roll 38 in a nip N-P as the forming fabric 16 travels to turning roll 19. The transfer roll also has an internal suction box 62 defined by upstream (leading) and downstream (trailing) seals 64,66 which subtend a vacuum zone 68 over the surface of the roll shell 70 which has a plurality of small holes 72 drilled in it to permit vacuum pressure to be applied to the vacuum zone 68 on its roll surface.

The leading seal 50 extends upstream of a line 74 drawn between the axes of revolution 76,78 of couch roll 38 and transfer roll 60, respectively, and through nip N-P. Similarly, the trailing seal 52 of couch roll 38 extends downstream of line 74 extending between the axes 76,78. The arrows show the direction of forming fabric and felt travel.

In a similar manner, both leading and trailing seals 64,66 in transfer roll 60 are downstream of line 74 through axes 76,78 and nip N-P.

In operation, the web W travelling on forming fabric 16 comes into vacuum zone 56 over the couch roll 38 where it is exposed to additional dewatering vacuum pressure and the white water is urged primarily into couch roll 38. Pick-up felt F-P is brought into nipping engagement N-P with the top surface of web W by transfer roll 60 over couch roll 38. Immediately downstream of nip N-P, forming fabric 16 wraps the web W and felt F-P over the surface of transfer roll 60 over an arcuate segment defined by angle $\alpha$ extending between line 74 and a radial line 57 between the axis of rotation 78 of the transfer roll to where fabric 16 leaves the transfer roll.

The belt pressure of the forming fabric 16 held over the arcuate segment of the transfer roll subtended by angle $\alpha$, in combination with the greater affinity of the wet web for the relatively more dense surface of pick-up felt F-P, compared with the interstices in the surface of forming fabric 16, combine to transfer the web onto the pick-up felt F-P. At a point over vacuum zone 68 on transfer roll 60, the forming fabric 16 is guided away from the web W, which is simultaneously exposed to the vacuum pressure over vacuum zone 68 on the surface of the transfer roll to maintain the web on the felt. The web W is then guided into the press section by being adhered to the underside of felt F-P.

The trailing seal 52 in couch roll 38 defines a small arcuate portion 57 of the vacuum zone 56 downstream of nip N-P. This serves to urge water expressed from the web through the interstices of forming fabric 16 either through the foraminous surface of the roll shell 39 of the couch roll or downwardly and away from forming fabric 16. Either way, this action in conjunction with the forming fabric wrapping the web over the transfer roll prevents rewetting of the web.

Thus, the web is dewatered before and during its pass through nip N-P. Water on the top side of the web is received into pick-up felt N-P, while water expressed through the underside of the web is urged downwardly through the forming fabric 16 and away from the web. At the same time, the web W is positively transferred onto the pick-up/press felt F-P.

Naturally, some variations in the structure and method can be effected without departing from the spirit and scope of the invention as claimed. For example, various types of forming fabrics and pick-up felts can be used. Some forming fabrics are made of plastic and some are made of metal strands. Similarly, some pick-up fabrics are also made of plastic mesh. Naturally, this invention is not limited to paper webs formed on two-fabric forming apparatus. What is significant is that the web can be additionally dewatered as well as transferred from the forming fabric onto a pick-up fabric and carried directly into the first press nip in a papermaking machine.

What is claimed is:

1. In a web pick-up in a papermaking machine including a looping forming fabric for carrying a paper web, a couch roll having a foraminous shell within the looped forming fabric, a looped web pick-up felt and a transfer roll having a framinous shell within the looped pick-up felt, the combination comprising:

the couch roll and transfer roll each include a suction box having longitudinally extending, angularly positioned leading and trailing seals which define a vacuum zone on the surface of each of their respective foraminous roll shells;

the transfer roll is nipped with the couch roll with the pick-up felt pressing the web over the forming fabric;

a fabric turning roll within the looped forming fabric downstream of the couch roll, said fabric turning roll cooperating with the couch roll to direct the forming fabric to partially wrap the transfer roll downstream of the nip with the web and pick-up felt therebetween;

the trailing seal in the couch roll and the leading seal in the transfer roll are positioned downstream of the nip, the trailing seal in the couch roll is also positioned downstream of where the forming fabric and web leave the couch roll in order to partially wrap, with the pick-up felt, the transfer roll;

whereby the web is subjected to dewatering forces through the forming fabric upstream of the trailing seal in the couch roll and water is urged away from the web and forming fabric downstream of the nip.

2. The web transfer apparatus as set forth in claim 1, wherein:

the trailing seal in the transfer roll is positioned no further upstream than where the web leaves the forming fabric.

3. The web transfer apparatus as set forth in claim 1, wherein:

the trailing seal in the transfer roll is positioned downstream of the location where the web leaves the forming fabric.

* * * * *